United States Patent [19]

Taylor

[11] Patent Number: 4,460,846

[45] Date of Patent: Jul. 17, 1984

[54] COLLECTOR-OUTPUT FOR HOLLOW BEAM ELECTRON TUBES

[75] Inventor: Norman J. Taylor, Wenham, Mass.

[73] Assignee: Varian Associates, Inc., Palo Alto, Calif.

[21] Appl. No.: 510,465

[22] Filed: Jul. 1, 1983

Related U.S. Application Data

[63] Continuation of Ser. No. 251,612, Apr. 6, 1981, abandoned.

[51] Int. Cl.[3] ..... H01J 23/02

[52] U.S. Cl. ..... 315/5.38; 315/5.0

[58] Field of Search ..... 315/5.38

[56] References Cited

U.S. PATENT DOCUMENTS 2,486,398 11/1949 Feenberg ..... 315/5.38

*Primary Examiner*—Harold Dixon

*Attorney, Agent, or Firm*—Stanley Z. Cole; Peter J. Sgarbossa; Richard B. Nelson

[57] ABSTRACT

In a microwave electron tube such as a gyrotron, a hollow beam of electrons passes thru the interaction cavity into an output waveguide carrying the generated energy in a mode with circular electric fields. According to the invention, the beam is caused to expand, passing thru a gap in the waveguide to be collected on a larger, surrounding collector. The collector energy is thus reduced. The wave energy jumps the gap and continues down the waveguide. Wave energy leaking into the collector may be absorbed by lossy material therein or be carried off by waveguides to external loads.

6 Claims, 4 Drawing Figures

FIG. 1
PRIOR ART
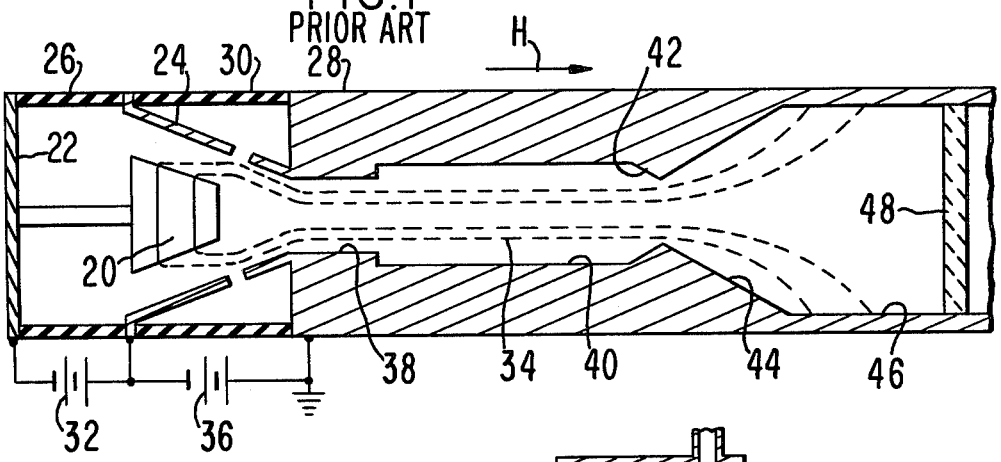
FIG. 2
PRIOR ART
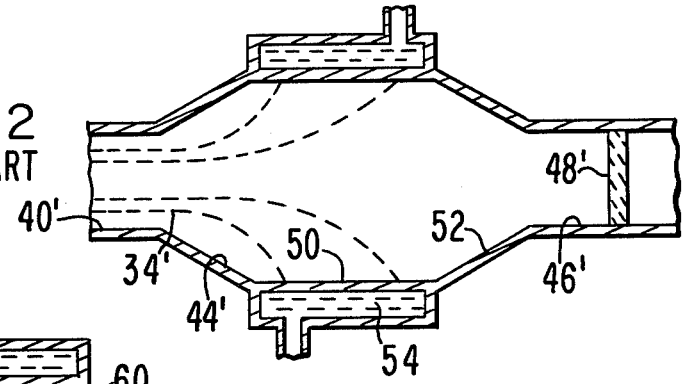
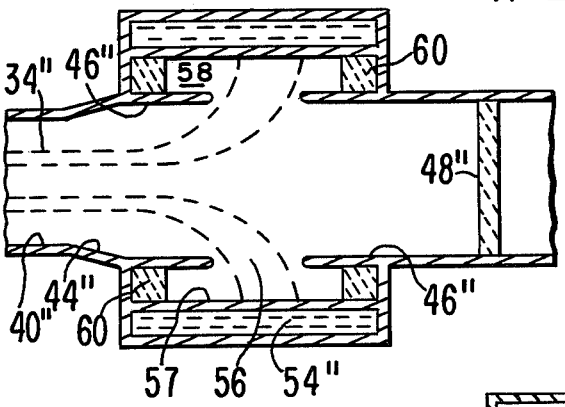
FIG. 3
FIG. 4
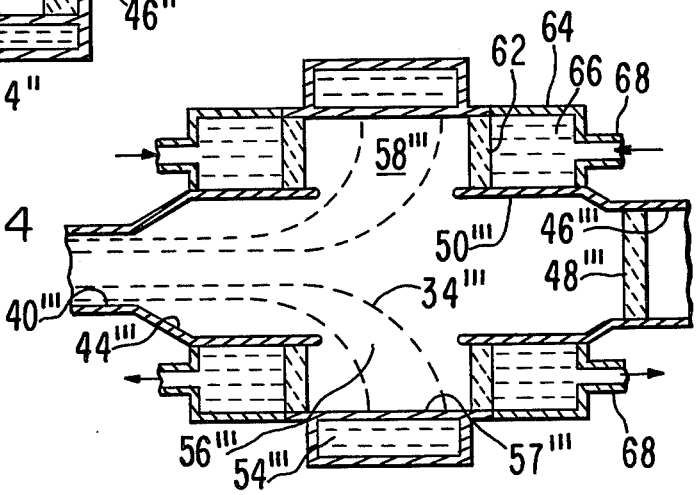

COLLECTOR-OUTPUT FOR HOLLOW BEAM ELECTRON TUBES

This is a continuation of application Ser. No. 251,612, filed Apr. 6, 1981, now abandoned.

DESCRIPTION

1. Field of the Invention

The invention pertains to electron tubes for generating very high power at very high frequency. The gyrotron is a modern example. Such tubes typically use wave propagating circuits operating in a higher-order mode such as a mode with circular electric field.

Prior Art

Gyrotron tubes have generally been built with a beam-interaction cavity designed for supporting an electromagnetic wave in a $TE_{oml}$ mode. Accidental conversion of this mode to other modes which can also be supported in the cavity is a problem. Conversion to non-circular-field modes is caused by any departure of the circuits from circular symmetry. Thus, it has been common practice to make the output waveguide cylindrical, coaxial with the interaction cavity, and adapted to propagate the $Te_{om}$ mode. The hollow electron beam is expanded by terminating the axial magnetic focusing field. The beam is then collected on the surrounding waveguide wall, while the wave continues on through a dielectric output window.

A principal disadvantage of the prior art arrangement is that the size, and thus the power-dissipating ability of the collector, is limited by the waveguide diameter.

This power limitation may be aided by increasing the diameter of the waveguide. If this is then subsequently reduced in diameter prior to the output window, for example, some of the higher order modes created at the taper discontinuities may be trapped and resonate. If sufficient loss is not provided in the expanded section, the amplitudes may build to such a level that the operation of the tube is disrupted through reflection to the cavity in modes capable of transmission to it. This results in erratic output and often frequency skipping to competing modes.

In the design of some gyrotrons it is found that the magnetic field can no longer control the beam along the length of an extended collector. It is then necessary to further increase the diameter of the collector to provide sufficient area for beam dissipation. This means either increased discontinuities or excessively long tapers.

SUMMARY OF THE INVENTION

An object of the invention is to provide a gyrotron tube with increased power.

A further object is to provide a gyrotron tube with reduced spurious oscillations.

These objects are achieved by a transverse gap in the output waveguide thru which the spent electron beam is directed from the guide outward into a larger, surrounding cavity on whose walls it is collected. Wave energy leaking into the collector cavity is absorbed by a load which may be inside the collector vacuum envelope or external to it.

BRIEF DESCRIPTION OF THE DRAWINGS

FIG. 1 is a schematic axial section of a prior art gyrotron oscillator.

FIG. 2 is a schematic axial section of the output section of a modified prior art gyrotron.

FIG. 3 is a schematic axial section of the output section of a gyrotron embodying the invention.

FIG. 4 is a schematic axial section of the collector section of a modified embodiment.

DESCRIPTION OF THE PREFERRED EMBODIMENTS

FIG. 1 is a sketch of a prior art gyrotron oscillator of the monotron type. The gyrotron is a microwave tube in which a beam of electrons having spiral motions in an axial magnetic field parallel to their drift direction interact with the transverse electric fields of a wave-supporting circuit. The eletric field in practical tubes is in a circular- electric-field mode. In the gyro-klystron the wave- supporting circuit is a resonant cavity, usually resonating in a $TE_{oml}$ mode.

In the gyro-monotron of FIG. 1 a thermionic cathode 20 is supported on the end plate 22 of the vacuum envelope. End plate 22 is sealed to the metallic accelerating anode 24 by a dielectric envelope member 26. Anode 24 in turn is sealed to the main tube body 28 by a second dielectric member 30. In operation, cathode 20 is held at a potential negative to anode 24 by a power supply 32. Cathode 20 is heated by a radiant internal heater (not shown). Thermionic electrons are drawn from its conical outer emitting surface by the attractive field of the coaxial conical anode 24. The entire structure is immersed in an axial magnetic field H produced by a surrounding solenoid magnet (not shown). The initial radial motion of the electrons is converted by the crossed electric and magnetic fields to a motion away from cathode 20 and spiralling about magnetic field lines, forming a hollow beam 34. Anode 24 is held at a potential negative to tube body 28 by a second power supply 36, giving further axial acceleration to the beam 34. In the region between cathode 20 and body 28, the strength of magnetic field H is increased greatly, causing beam 34 to be compressed in diameter and also increasing its rotational energy at the expense of axial energy. The rotational energy is the part involved in the useful interaction with the circuit wave fields. The axial energy merely provides beam transport through the interacting region.

Beam 34 passes through a drift-tube or aperture 38 into the interaction cavity 40 which is resonant at the operating frequency in a $TE_{oml}$ mode. The magnetic field strength H is adjusted so that the cylotron-frequency rotary motion of the electrons is approximately synchronous with the cavity resonance. The electrons can then deliver rotational energy to the circular electric field, setting up a sustained oscillation.

At the output end of cavity 40 the inner wall of body 28 may be tapered in diameter to form an iris 42 of size selected to give the proper amount of energy coupling out of cavity 40. In very high power tubes there may be no constricted iris, the cavity being completely open-ended for maximum coupling. In either case, an outwardly tapered section 44 couples the output energy into a uniform waveguide 46 which has a greater diameter than resonant cavity 40 in order to propagate a traveling wave. Near the output of cavity 40 the magnetic field H is reduced. Beam 34 thus expands in diameter under the influence of the expanding magnetic field lines and its own self-repulsive space charge. Beam 34 is then collected on the inner wall of waveguide 46, which also serves as a beam collector. A dielectric window 48, as of alumina ceramic, is sealed across waveguide 46 to complete the vacuum envelope.

Since the beam collector 46 is also the output waveguide, its diameter is limited by the propagating dimensions for the operating $TE_{om}$ mode. Thus, its energy-dissipating capability is also limited. It is found that as TEom gyrotrons are scaled up in frequency the control of the electron beam in the collector becomes weak and therefore it becomes difficult using axisymmetric fields to spread the beam over an extended length of collector.

FIG. 2 is a sketch of the output portion of another prior art gyrotron. Here the cavity 40' is coupled thru a taper section 44' to a collector section 50 which has a diameter considerably larger than the remainder of the output waveguide 46'. A second taper 52 slowly reduces the diameter from collector 50 to waveguide 46'. The wave passes thru waveguide 46' thru a dielectric window 48' to the useful load. The scheme of FIG. 2 reduces the dissipation power density because collector 50 is larger than the waveguide-sized collector of FIG. 1. However, the tapers themselves can cause mode conversion, generally from one mode with circular symmetry to another with the same symmetry. Since the beam collector 50 is also the output waveguide, its diameter is limited by the acceptable lengths of taper (up to it and down to the output guide) required to keep mode conversion to a small level. Also, the section of enlarged waveguide formed by the collector 50 can support higher order modes for which waveguide 46' and cavity 40' are cut off so that these modes cannot escape from the enlarged section. The Q of this section is thus very high and the spurious modes can build up to dangerously large amplitudes. These cause, through conversion to cavity-supported modes and reflection to the cavity, a disruption of the interaction, a loss of output and often frequency skipping to a competitive mode. For this reason, loss is normally provided in the expanded diameter collector to limit the amplitude of the trapped resonances. This may be in the form of a small gap of dimension such that the loss of the desired propagating modes is small, while spurious modes are propagated out and externally absorbed.

FIG. 3 is a section of the output end of a gyrotron tube embodying the invention. The resonant cavity 40'' is connected by a tapered section 44'' to waveguide 46'' which is only slightly larger in diameter than cavity 40'', but large enough to carry a traveling wave. This small taper is less prone to mode conversion than the large taper of prior art FIG. 2.

Waveguide 46'' continues thru window 48'' to the useful load. Waveguide 46'' is interrupted by a gap 56 in the region where beam 34'' expands. The magnetic field pattern is shaped so that beam 34'' passes thru gap 56 without hitting waveguide 46''. Beam 34'' continues to expand and is collected on the inside surface 57 of the enlarged collector chamber 58. Collector surface 57 is cooled by circulating water or other fluid 54''. Inside the ends of collector 58 removed from beam 34'' are inserted rings of wave-absorbing dielectric material 60, such as a beryllia ceramic containing particles of silicon carbide, a very lossy material. Ring 60 may be brazed to the water-cooled wall of collector cavity 58 for conduction cooling, or it may be suspended so it can heat up and radiate the power it absorbs. For additional loss, some inner walls of collector 58 may be coated with a high-resistance metallic coating. These lossy elements absorb any microwave radiation entering collector 58 thru waveguide gap 56, thus preventing the build-up of large amplitude resonances.

The amount of wave energy leaking out of waveguide 46'' into collector 58 is a decreasing function of the diameter of waveguide 46'' and an increasing function of the length of gap 56, both measured in free-space wavelengths. Both theoretical calculations and experimental measurements have demonstrated that the energy loss in a practical tube can be made tolerable. For example, measurements on a 5" diameter waveguide show that we could have a gap of 6.5" with a loss of less than 4% at 120 GHz in the $TE_{02}$ mode of propagation, and we could have a 12" gap with less than 10% loss. These gaps could allow the electron beam to pass to a collector of sufficient diameter to allow proper dissipation.

FIG. 4 is a section of the output end of a gyrotron employing a somewhat different embodiment. Here the waves absorbing function in collector cavity 58''' is performed by sealing one or both ends with a wave-propagating dielectric window 62. Window 62 is preferably of low-loss material such as high-alumina ceramic. Outside windows 62 are water-load sections 64 containing lossy dielectric fluid 66, such as water, circulating thru inlet and outlet pipes 68. The unwanted wave energy is absorbed directly in the body of fluid 66, so the problem of convective heat transfer is greatly reduced. Alternatively, cavity 58'' may be extended beyond windows 62 as air-filled waveguides terminated by any kind of conventional waveguide loads.

In the embodiment of FIG. 4 the output waveguide 46''' may be tapered to a larger diameter 50''' similarly to the scheme of FIG. 3, the difference being that in FIG. 4 the surface 50''' does not have to dissipate the beam energy which is received on the even larger surface 57''' of collector cavity 58'''.

The embodiments described above are intended to be illustrative and not limiting. Many variations of the invention will become obvious to those skilled in the art. The invention may be applied to any microwave tube using an output waveguide carrying a circular electric field mode. At present, the gyrotron is the most successful of such tubes, but others may be devised. Also, other methods of damping the energy entering the collector may be used. The invention is intended to be limited only by the following claims and their legal equivalents.

I claim:

1. In a gyrotron type microwave electron tube:

means for generating a hollow beam of electrons;

means for supporting an electromagnetic wave in energy exchanging interaction with said beam;

circular waveguide means of generally uniform cross-section and coaxial with said beam for conducting energy from said interaction to an external load in a mode having circular electric fields;

said waveguide defining therein a transverse gap for passage of said beam outwardly of said waveguide; and a hollow electron collector coaxial with and outside said waveguide, and surrounding said gap.

2. The tube of claim 1 in which said means for supporting said electromagnetic wave includes a resonant cavity, resonating in a circular electric field mode.

3. The tube of claim 2 in which said cavity has a first diameter, and said waveguide means has a second diameter slightly larger than said first diameter.

4. The tube of claim 1 wherein said collector contains wave-absorbing dielectric material.

5. The tube of claim 1 further comprising a wave-transmissive dielectric window in said collector; and lossy dielectric material in wave-transmissive connection with said collector via said dielectric window.

6. The tube of claim 5 wherein said lossy dielectric material is water.

* * * * *